US007762281B2

(12) United States Patent
Schuld

(10) Patent No.: US 7,762,281 B2
(45) Date of Patent: Jul. 27, 2010

(54) STORAGE AND DISPENSING BIN

(75) Inventor: Ernest R. Schuld, Macomb, IL (US)

(73) Assignee: Bushnell Illinois Tanks Co., Bushnell, IL (US)

( * ) Notice: Subject to any disclaimer, the term of this patent is extended or adjusted under 35 U.S.C. 154(b) by 708 days.

(21) Appl. No.: 11/497,629

(22) Filed: Aug. 2, 2006

(65) Prior Publication Data

US 2008/0029546 A1 Feb. 7, 2008

(51) Int. Cl.
*F16K 35/14* (2006.01)
*B67D 7/06* (2010.01)
*G01F 11/28* (2006.01)

(52) U.S. Cl. ..... 137/637.1; 222/145.5; 222/145.7; 222/185.1; 222/428; 222/478; 222/484; 222/503; 222/506; 222/561; 137/637

(58) Field of Classification Search ..... 222/23, 222/185.1, 129, 144.5, 561, 559, 481–487, 222/145.4, 145.7, 181.2, 428, 479, 503, 506; 116/277; 137/637, 637.1
See application file for complete search history.

(56) References Cited

U.S. PATENT DOCUMENTS 2,578,042 A * 12/1951 Chandler ..... 222/6
2,614,520 A * 10/1952 Allen ..... 116/277
3,301,441 A * 1/1967 Werner et al. ..... 222/146.3
3,318,473 A * 5/1967 Jones et al. ..... 414/608
3,497,109 A * 2/1970 Leach ..... 222/144.5
3,972,451 A * 8/1976 Parish et al. ..... 222/485
4,039,062 A * 8/1977 Carre et al. ..... 193/31 R
4,523,690 A * 6/1985 Cornelius ..... 220/262
4,646,942 A * 3/1987 Kuhns ..... 222/144.5
5,570,547 A * 11/1996 Webb et al. ..... 52/194
6,328,183 B1 * 12/2001 Coleman ..... 222/185.1
7,114,638 B2 * 10/2006 Vaynshteyn et al. ..... 222/181.1
7,140,516 B2 * 11/2006 Bothor et al. ..... 222/185.1
7,316,333 B2 * 1/2008 Wegner ..... 222/181.1

* cited by examiner

*Primary Examiner*—Kevin P Shaver
*Assistant Examiner*—Melvin A Cartagena
(74) *Attorney, Agent, or Firm*—Greer, Burns & Crain, Ltd.

(57) ABSTRACT

A bin for storing and dispensing dry flowable material comprises a main body portion defining a chamber for receiving the flowable material, a top portion enclosing the top of the body portion and having an inlet through which the material can pass to fill the bin, a bottom portion enclosing the bottom of the body portion and having at least one outlet, the bottom portion being inclined to direct the material toward the at least one outlet, a wall extending upwardly from the at least one outlet to an elevation in the body portion for dividing at least a lower part of the chamber into adjacent sections and a valve mechanism for selectively controlling the dispensing of the material from each section.

11 Claims, 7 Drawing Sheets

STORAGE AND DISPENSING BIN

BACKGROUND OF THE INVENTION

The present invention generally relates to storage and dispensing bins, and more particularly to bins for storing and dispensing dry flowable materials.

Storage and dispensing bins are frequently used to store and dispense granular and other flowable materials, such as livestock and other animal feedstuffs, plant seed or other particulate and/or pelletized materials. In particular, feed storage bins are commonly used to store and dispense livestock feedstuffs such as oats, corn, milo, barley, and alfalfa pellets. The bins typically include a cylindrical hopper body with a conical funnel portion at a bottom end thereof, wherein the conical funnel portion includes an outlet through which the feedstuffs are dispensed. The feedstuffs are often dispensed into an augur system for delivery to livestock, but may be dispensed using less sophisticated equipment.

However, common problems are associated with conventional feed storage bins. For example, as the supply within the bins is dispensed and begins to diminish, it is difficult to easily ascertain how much feedstuffs remain. The bins are usually made of steel or other non-transparent material, and are therefore not amenable to external visual inspection. Thus, it is difficult to know when to re-order feedstuffs or refill the bins. Often times, feedstuffs are entirely depleted from a storage bin before the dwindling supply is noticed, at which time immediate refilling of the bin may not be a feasible option.

Additionally, animals such as horses are notoriously finicky when it comes to the freshness of their feedstuffs. Unfortunately, the shape of the conical funnel portion in combination with the inherent physical properties of the granular feedstuffs contribute to spoilage of at least a portion of the feedstuffs stored within the bins. Specifically, as the feedstuffs descend down the cylindrical hopper portion for dispensing through the conical funnel portion, there is often a residual layer that naturally forms around a portion of the inner circumference of the conical funnel portion. This phenomenon occurs because of one of the inherent physical properties of each particular feedstuff or dry flowable material, known as the angle of repose, or the angle formed with a horizontal surface when free-flowing material comes to rest. Thus, the feedstuffs will flow from top to bottom, while a residual layer around a portion of the inner circumference of the conical funnel portion remains. The residual layer typically includes the feedstuffs that were first deposited in the bin, and by the time this layer is finally dispensed, which is only after the balance of the bin has been emptied, there is a "first in, last out" result. In other words, the oldest of the feedstuffs are often dispensed last, and are frequently refused by the livestock.

SUMMARY OF THE INVENTION

Various embodiments of the invention comprise a bin for storing and dispensing dry flowable material comprises a main body portion defining a chamber for receiving the flowable material, a top portion enclosing the top of the body portion and having an inlet through which the material can pass to fill the bin, a bottom portion enclosing the bottom of the body portion and having at least one outlet, the bottom portion being inclined to direct the material toward the at least one outlet, a wall extending upwardly from the at least one outlet to an elevation in the body portion for dividing at least a lower part of the chamber into adjacent sections and a valve mechanism for selectively controlling the dispensing of the material from each section.

DETAILED DESCRIPTION OF THE PREFERRED EMBODIMENTS

Figure 1:
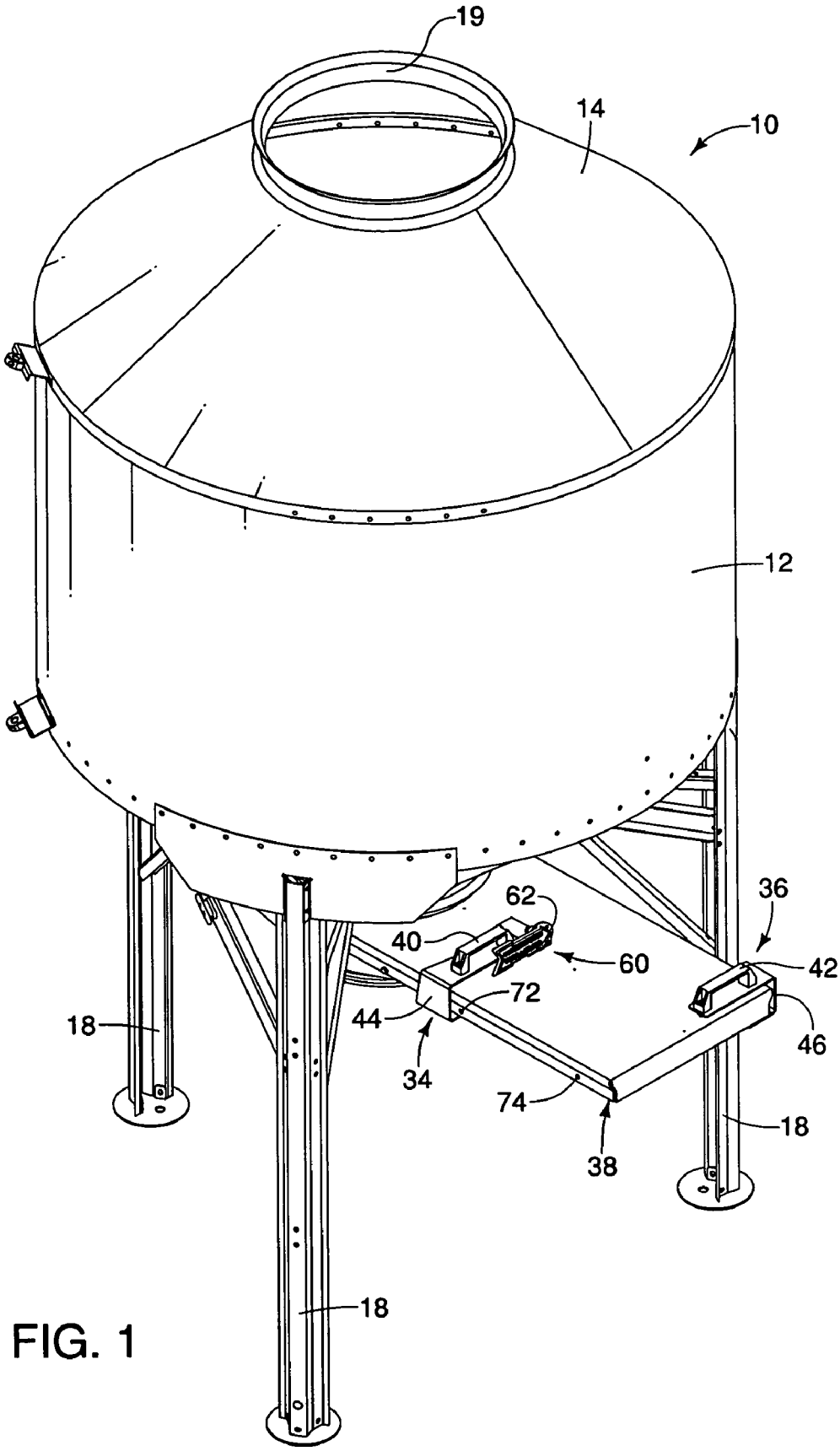
FIG. 1 is a perspective view of the dispensing bin embodying the present invention shown from an upper front left vantage point.

Embodiments of the invention provide a storage and dispensing bin for use with dry, flowable material, such as livestock feedstuffs, that enhances the ability of a worker to ascertain an amount of feedstuffs remaining in the bin while simultaneously reducing spoilage of feedstuffs within the bin.

Turning to FIGS. 1-4, the preferred embodiment is a storage and dispensing bin, designated generally at 10, that includes a generally cylindrical hopper body 12, a conical-shaped receiving end portion 14 at an upper end of the hopper body, and a conical-shaped funnel portion 16 at a lower end of the hopper body. The body is supported by a support frame 18 that includes three legs although a greater number of legs may be utilized. An inlet 19 is disposed at an upper end of the receiving end portion 14, while an outlet 20 is provided at a tapered lower end of the funnel portion 16. An internal chamber 22 of the bin 10 includes the combined volumes defined by the hopper body 12, the receiving end portion 14 and the funnel portion 16. The internal chamber 22 is configured to receive material therein via the inlet 19, and includes features to reduce spoilage and promote monitoring of the volume of material disposed therein.

Figure 2:
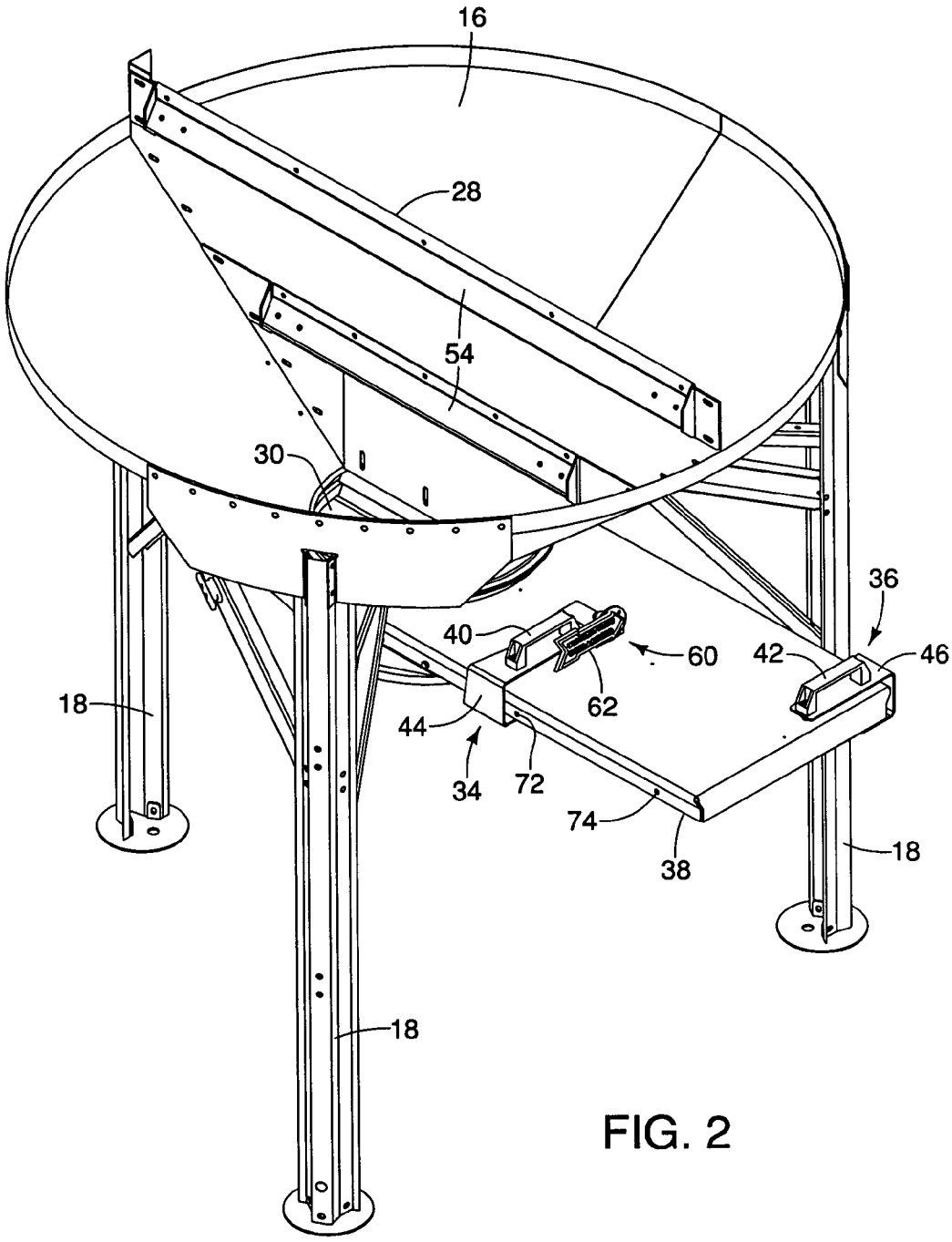
FIG. 2 is another perspective view of the dispensing bin shown in FIG. 1, taken from the same vantage point as FIG. 1, but with the upper portion removed to reveal internal construction.
Figure 3:
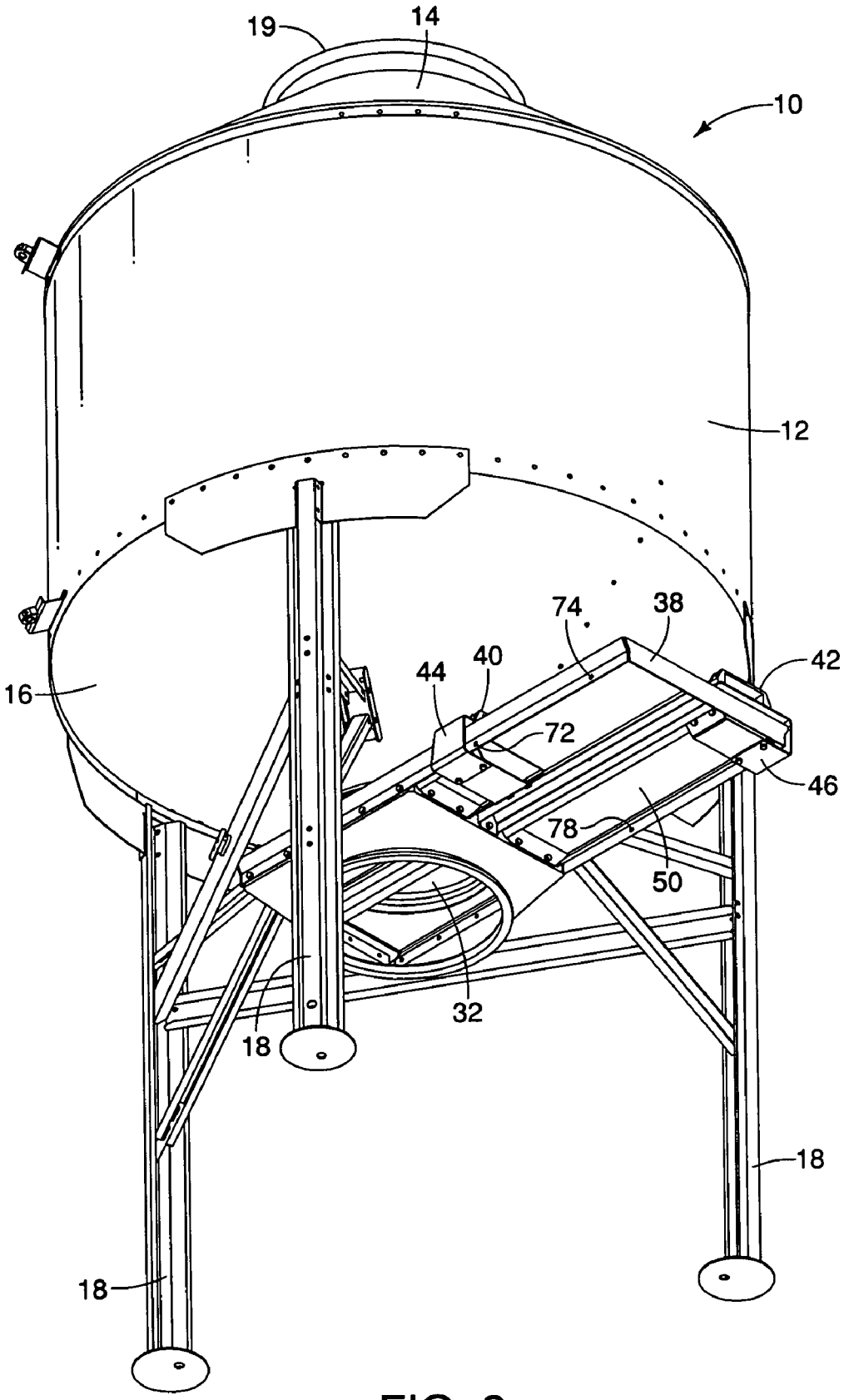
FIG. 3 is a perspective view of the dispensing bin of FIG. 1, shown from a lower front left vantage point.
Figure 4:
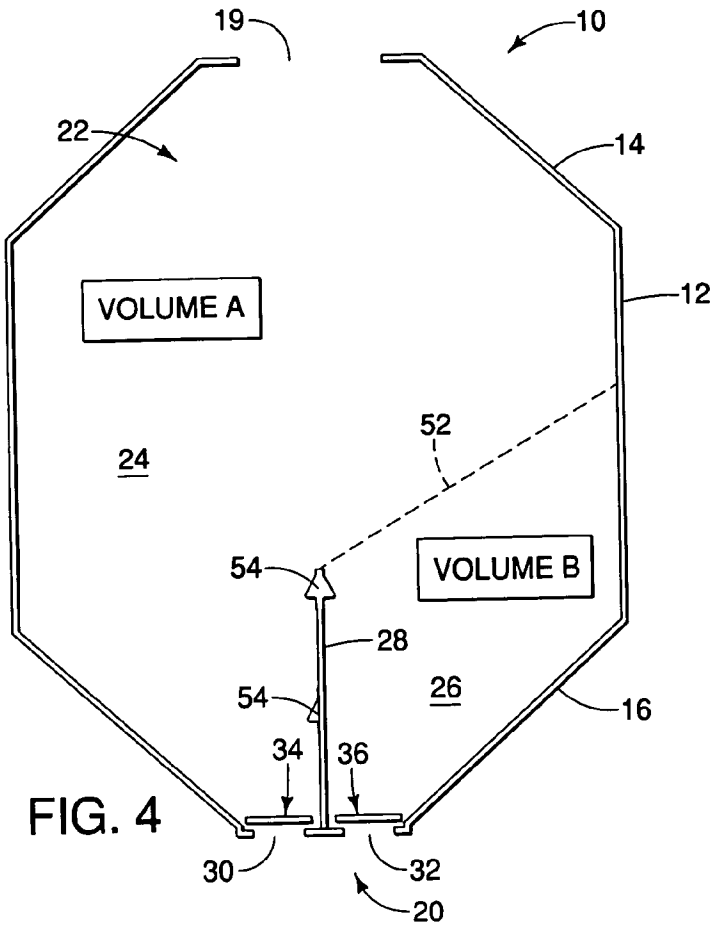
FIG. 4 is a simplified diagrammatic depiction of a cross section of the storage bin embodiment shown in FIGS. 1-3.

More specifically, as illustrated in FIG. 4, the internal chamber 22 includes a refill portion 24 (also identified as volume A), a reserve portion 26 (also identified as volume B), with a guide divider 28 provided for maintaining the separation of the refill portion from the reserve portion. The guide divider 28 is generally planar and is configured to correspondingly extend upwardly from the outlet 20 at least a predetermined portion of the internal chamber 22. As shown in FIGS. 2 and 4, it preferably extends from slightly above the top elevation of the conical funnel portion 16 downwardly to the outlet 20. Thus, the guide divider 28 generally extends across the hopper body 12 and funnel portion 16 to divide the lower portion of the internal chamber 22 into two preferably equal halves. Similarly, the outlet 20 is also divided into two parts, preferably left and right halves 30, 32 as shown. It should be understood that while a single outlet 20 is shown and described herein, there could be a separate outlet for each section, i.e., an outlet for each of the left and right halves 30, 32. Moreover, while only two sections are shown and described, additional sections are considered to be within the scope of the present invention.

Assuming that the outlet 20 is closed, as the particular feedstuffs are deposited into the dispensing bin 10 via the inlet 19, the internal chamber 22 begins to fill uniformly on both sides of the guide divider 28 until the internal chamber has reached its full holding capacity. The invention accordingly preferably provides a mechanism whereby first and second halves 30, 32 of the outlet 20 may be selectively opened or closed to permit dispensing of the material via one or the other of the halves.

More particularly, the preferred embodiment of the invention includes first and second slide valves, indicated generally at 34, 36 that correspond respectively to the first and second halves 30, 32 of the outlet 20 and that slide relative to a valve frame structure 38. The valve frame structure 38 is generally flat and is mounted on the bottom of the bin 10 adjacent to the outlet 20. The valve frame structure 38 also includes a generally circular opening (not shown) that is generally coextensive with the outlet 20. Each of the slide valves 34, 36 has respective handle portions 40 and 42 that are disposed on a top side of the valve frame structure 38. The respective handle portions 40 and 42 are mounted on respective brackets 44 and 46 that wrap around a side of the frame structure 38, where they are attached to elongated flat valve body structures 48 and 50.

Figure 5:
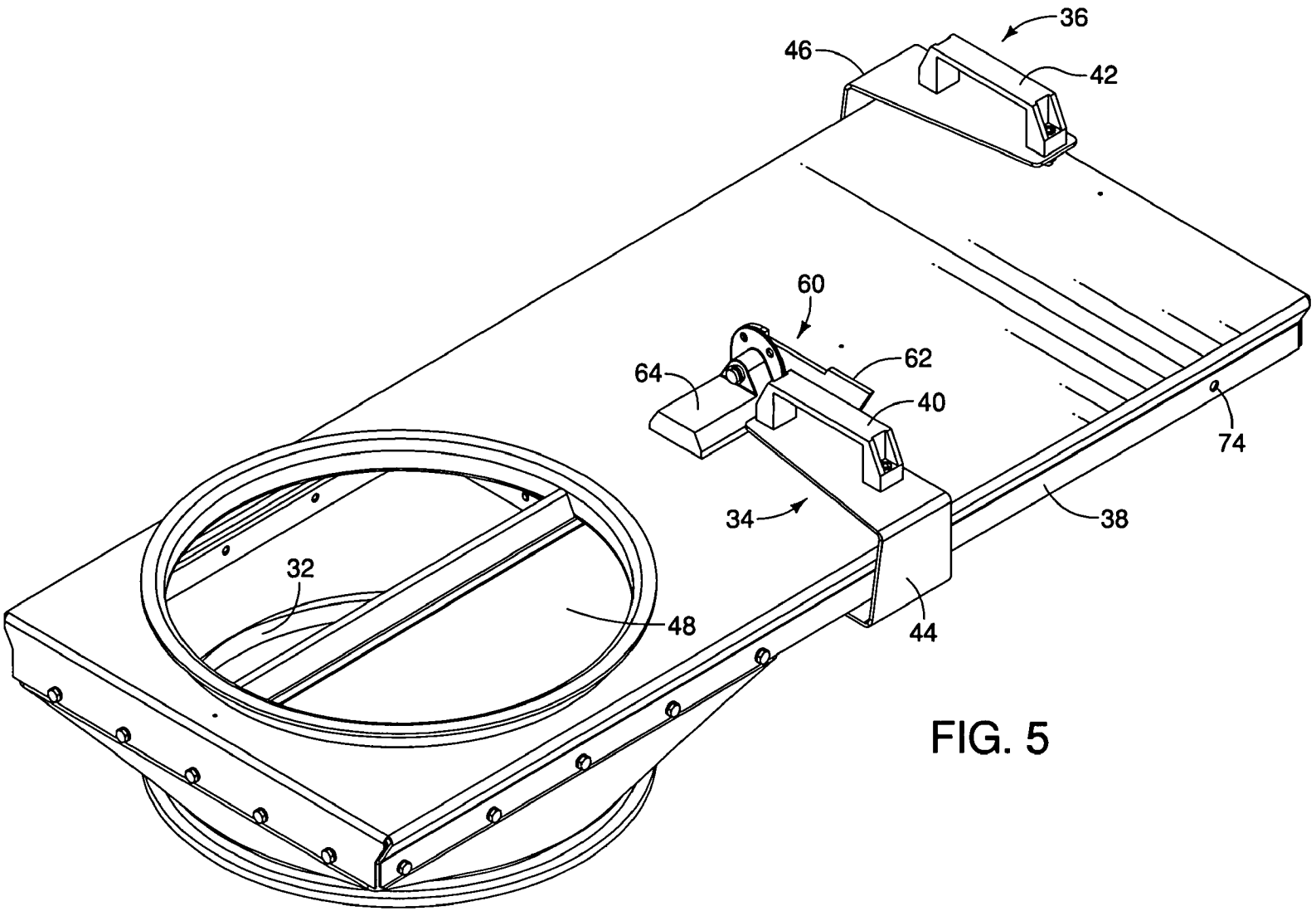
FIG. 5 is a perspective of a portion of the storage bin shown in FIG. 1 particularly illustrating the valve mechanism for controlling the dispensing of material, and is shown from an upper vantage point.
Figure 6:
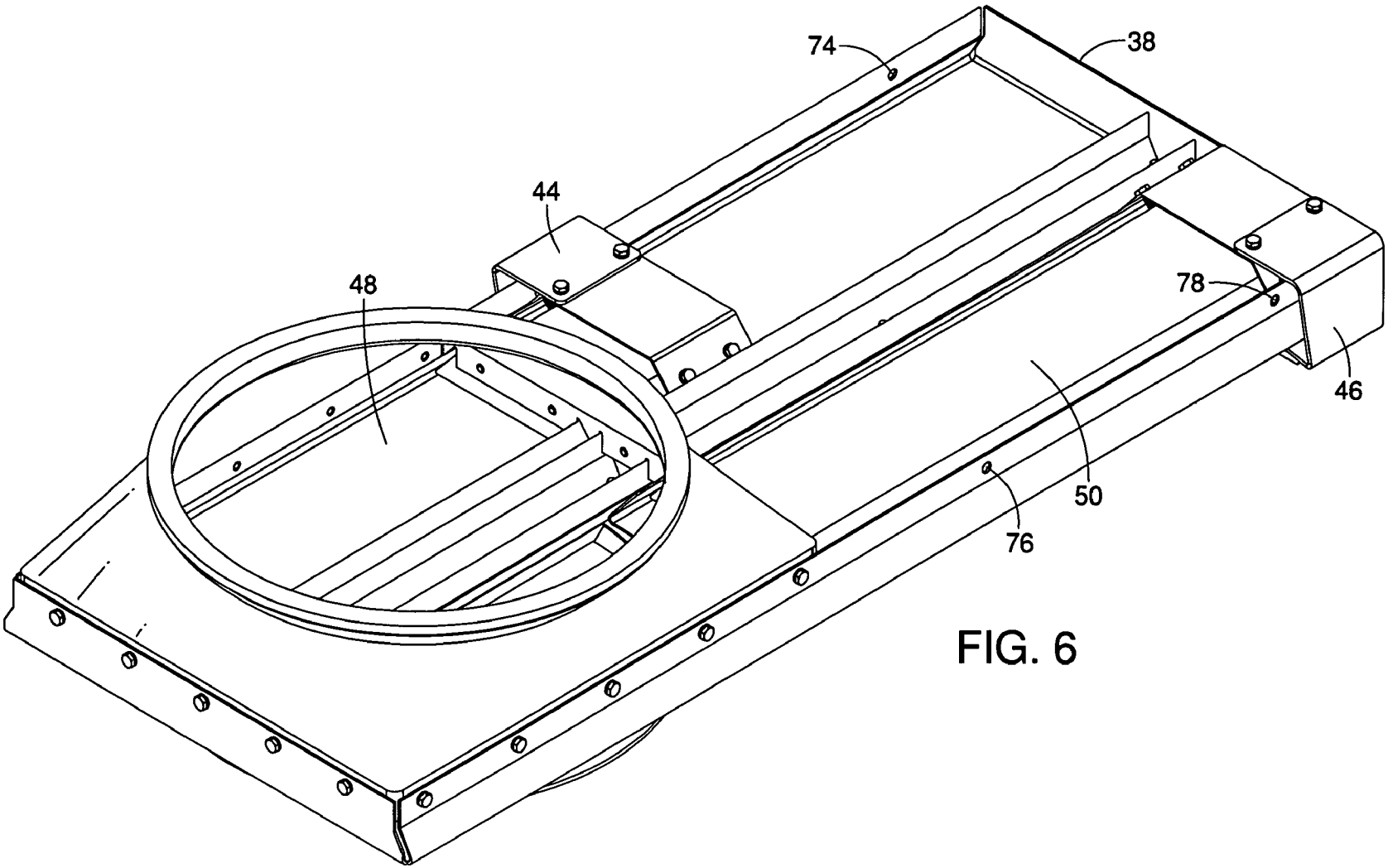
FIG. 6 is a bottom side view of the portion shown in FIG. 5.

As is best shown in FIGS. 4, 5 and 6, the slide valve 34 is closed, so that the body structure 48 is in position where it covers the outlet half 30 as the handle 40 is positioned very near the outlet. Also, slide valve 36 is shown in its open position, wherein the body structure 50 is retracted from the outlet half 32. The handle 42 is located in its retracted position near the outer end of the frame structure 38.

To promote selective dispensing of material from the bin 10, only one of the slide valves 34, 36 is preferably open at a time, with the other of the slide valves remaining closed. In this regard, and referring again to FIG. 4, whether a particular side of the internal chamber 22 is considered to be the refill portion 24 or the reserve portion 26 depends on which half 30, 32 of the outlet 20 is dispensing material, and the respective identities of these portions reverse upon the emptying of the refill portion 24.

More specifically, the height of the guide divider 28, together with the angle of repose of the material in the chamber determines the relative size of the reserve volume. The angle of repose is the angle formed by the free-flowing material at rest with respect to a horizontal surface, and in the instant embodiment, a plane that includes the top edge of the guide divider 28 becomes the horizontal surface with which the angle of repose is determined. Thus, rather than forming a layer of residual material along a portion of the funnel portion 16 as in conventional bins, a natural divide is formed between the refill and reserve portions 24, 26 at the angle of repose, designated in FIG. 4 at 52. The angle of repose is usually different for different flowable materials, but is generally within the range of about 19° to about 32° for most foodstuffs. The angle of repose 52 in FIG. 4 is shown to be 30°. While the guide divider 28 is shown to extend upwardly to a finite predetermined elevation, it should be understood that an adjustable divider construction could be used to vary the proportion of the reserve volume to the working volume.

As an example of the manner in which feedstuffs are dispensed, and referring to FIG. 4, when the slide valve 34 is in the open position while the slide valve 36 is in the closed position, the left half 30 of the outlet 20 is open for dispensing material from the bin 10, while the other half 32 of the outlet is blocked by the slide valve 36. Material therefore begins to flow from the "left" of the guide divider 28 to be dispensed from the left half 30 of the outlet 20. The angle of repose 52 will form as shown, thereby relegating the volume of material to the "left" of the guide divider as the refill portion 24 and the volume of material to the "right" of the guide divider 28 as the reserve portion 26. Material will continue to be dispensed from the refill portion 24 until the volume of material disposed on that side of the guide divider 28 is depleted.

At that time, the fact that no further material is being dispensed gives the worker a clear indicator that the bin 10 needs to be refilled and/or feedstuffs re-ordered. However, in the meantime, the worker may simply slide the slide valve 34 into the closed position, while sliding the slide valve 36 into the open position, thereby opening the right half 32 of the outlet 20 to dispense material from the reserve portion 26. It should be understood that a worker can open either of the slide valves 34 or 36 for a short time, such as that needed to fill a small feed wagon for example. The important point is that feedstuffs should be taken from whatever side is the "working" side until that side is depleted, at which time the reserve side can be used until the bin is refilled and the reserve side becomes the working side until it eventually is depleted.

One particular advantage of the invention is that the material may be refilled at any time subsequent to the emptying of a working side, such as portion 24 of FIG. 4. That is, once the slide valve is opened to permit dispensing of material from the reserve portion 26, the worker may either wait for a time estimated to correspond to the amount of material in the reserve portion 26, or may begin refilling the bin 10 to capacity. As the bin 10 is filled, the angle of repose 52 will be established in symmetrically opposite direction, so that the reserve portion 26 becomes the refill portion 24, and vice versa. Thus, the reserve portion 26 will empty itself of the material originally contained therein, and if the bin 10 has been refilled, will then commence emptying the additional volume of material associated with the refill portion 24, leaving a new reserve portion 26 on the opposite side of the guide divider 28.

Preferably, the capacity of the reserve portion 26 is configured to correspond to a predetermined period of time, such as five to ten day supply of feedstuffs. Generally, the guide divider 28, as measured from the bottom edge to the top edge, corresponds in height to approximately ⅓ to ½ of the total height of the internal chamber 22. A shorter guide divider 28 generally corresponds to a smaller volume reserve portion 26, while a taller guide divider generally corresponds to a larger volume reserve portion. Because the material that may be placed in the bin can be quite heavy, particularly if the size of the bin is large, it is desirable to place stiffening members on one or both sides of the guide divider 28 at one or more elevations. As shown in FIG. 2, stiffening members 54 are provided on both sides of the top of the guide divider 28 and on one side generally midway up the divider 28.

Figure 8:
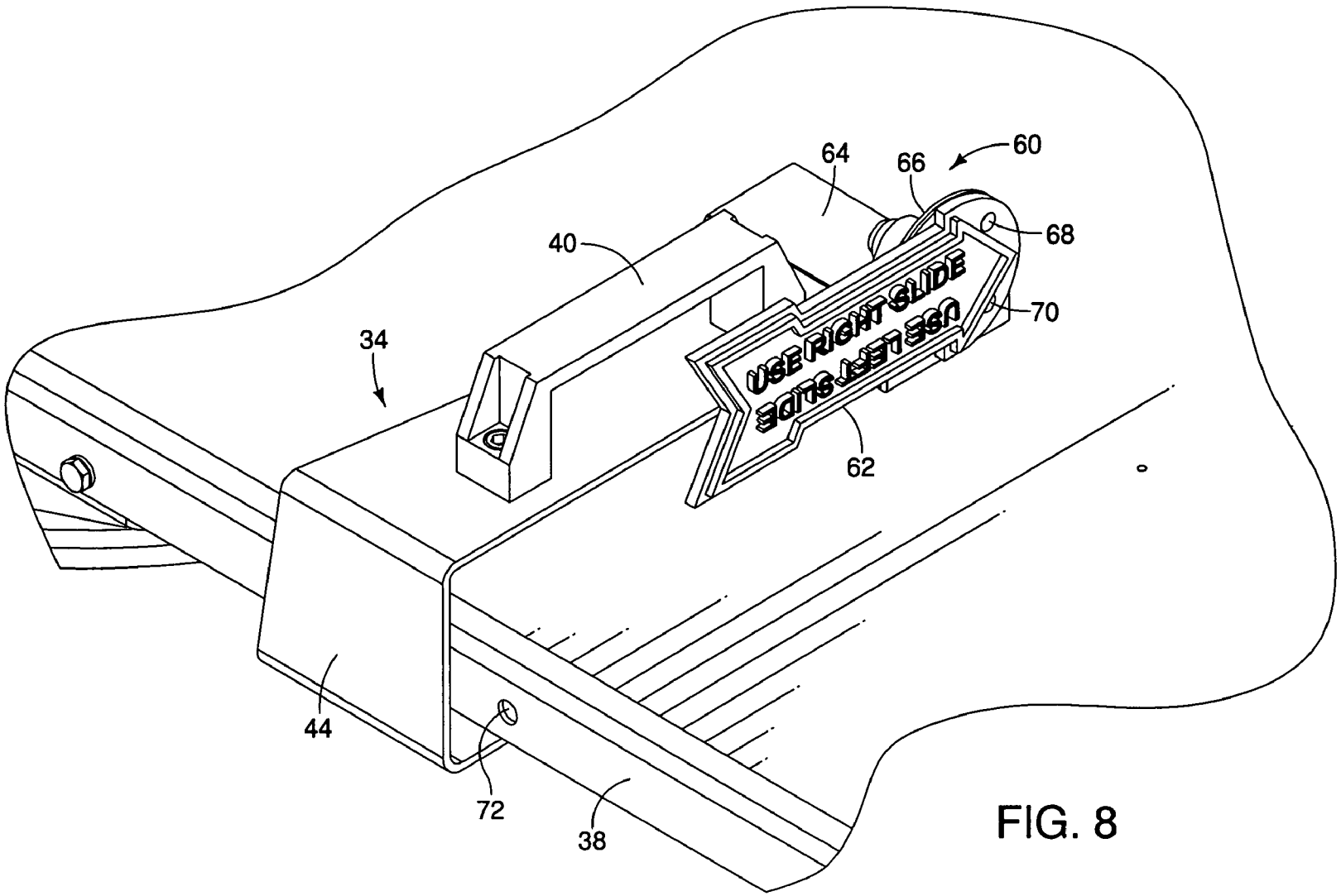
FIG. 8 is a front view of a portion of the indicator mechanism of the preferred embodiment.

As shown in FIGS. 1, 2 and 8, the preferred embodiment also includes an indicator mechanism, indicated generally at 60, to indicate which of the respective slide valves 34, 36 are to be used, i.e., which side is to be the working side. The mechanism 60 has a directional arrow indicator 62 that is pivotable around its point so that it can point to the left or to the right. The mechanism is placed between the two slide valve handle portions 40 and 42 can also operate as a physical barrier to opening one of the valves. The mechanism 60 includes a mounting member 64 for coupling to the valve frame structure 38 and an elongated, rotating arrow indicator 62 affixed thereto. The mounting member 64 is preferably attached to the valve frame structure 38 intermediate the slide valves 34, 36.

When the right slide valve 36 is to be used, the rotating arrow indicator 62 is rotated such that a length of the arrow is aligned with the handle portion 40 of the slide valve 34 to effectively block the handle portion 40 from being grasped by the worker. At the same time, the arrowhead of the rotating arrow indicator 62 points to the opposite side to indicate that the slide valve 36 should be used. The arrow indicator also has the instruction "USE RIGHT SLIDE" that is visible to the worker. Once the worker determines that the working side has been depleted, worker may close the slide valve 36, rotate the rotating arrow indicator 62 such that the elongated portion of the rotating arrow blocks the handle portion 42 of the slide valve 36. When the arrow indicator 62 is rotated, the previously upside down text will be visible for normal reading, i.e., "USE LEFT SLIDE". The slide valve 34 is then unblocked and can be used to dispense material from the other side.

To guard against someone inadvertently or intentionally changing the position of the arrow indicator 62 when it should not be changed, the mounting member has a front flange 66 to which the arrow indicator 62 rotates and it has an aperture 68 that is aligned with a corresponding aperture (not shown) in the front flange 66 when in the position illustrated in FIG. 8. This enables a padlock to be placed through the apertures and lock the arrow in the illustrated position. When the arrow indicator 62 is rotated to the opposite direction, an aperture 70 is then aligned with the aperture in the front flange 66 enabling a padlock to lock the arrow indicator 62 in the opposite direction.

Similarly, to guard against theft or unintended manipulation of the slide valves 34 and 36, the valve frame structure 38 has an aperture 72 that a padlock can be used to lock the slide valve 34 in a closed position as shown in FIGS. 1-3 and 8, as well as an aperture 74 for a padlock to lock it in an open position, as shown in FIGS. 1 and 6. Corresponding apertures 76 and 78 can have a padlock installed to lock the slide valve 36 in the open position and closed positions (see FIGS. 3 and 6).

While the preferred embodiment of the invention includes slide valves 34, 36 for selectively opening or closing first and second halves 30, 32 of the outlet 20, other types of valves, such as clam gate valves, rack and pinion valves as well as various motor driven valves can be used as is known to those of ordinary skill in the art. The slide valves described are easy to operate, effective, reliable and relatively inexpensive.

Figure 7:
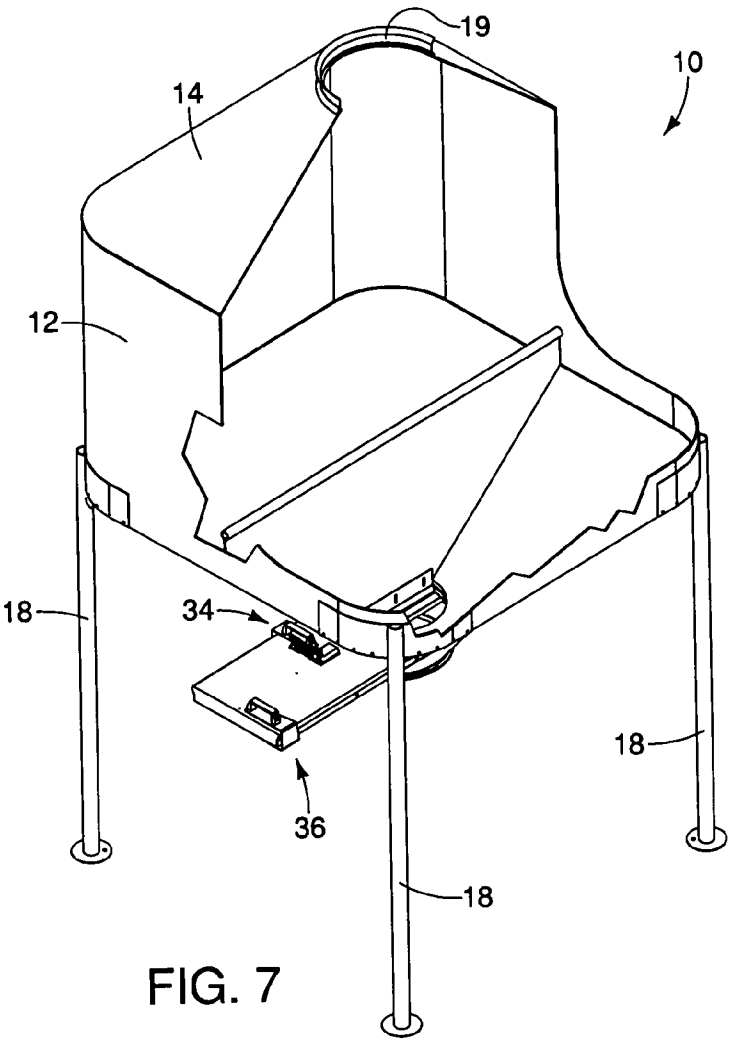
FIG. 7 is an alternative embodiment illustrating a generally square dispensing bin.

While the preferred embodiment shown in FIGS. 1-3, 5, 6 and 8 has a cylindrical housing 12 and a three legged support frame structure 18, as is shown in FIG. 7, the housing can be generally rectangular, preferably with rounded corners, if desired. This alternative embodiment also has a support frame with four legs.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A bin for storing and dispensing dry flowable material, comprising:

a main body portion defining a chamber for receiving the flowable material;

a top portion enclosing the top of said body portion and having an inlet through which the material can pass to fill the bin;

a bottom portion enclosing the bottom of said body portion and having at least one outlet, said bottom portion being inclined to direct the material toward said at least one outlet;

a wall extending upwardly from said at least one outlet to an elevation in said body portion for dividing at least a lower part of said chamber into adjacent sections;

a valve mechanism for selectively controlling the dispensing of the material from each section, wherein said wall extends upwardly from said outlet of the bottom portion within the range of approximately ⅓ to approximately ½ of the distance between said inlet and said outlet; and an indicator mechanism for directing the operation of a pair of slide valves configured to slide between open and closed positions so that only one slide valve can be in an open position at a time, wherein said indicator mechanism comprises an indicator member that is mounted adjacent said slide valves and is movable between first and second positions, said member preventing operation of one of said slide valves when placed in said first position and preventing operation of the other of said slide valves when placed in said second position.

2. A bin as defined in claim 1 wherein said main body portion comprises a generally cylindrically shaped wall, the inside of which defines said chamber.

3. A bin as defined in claim 1 wherein said main body portion comprises a generally rectangular shaped horizontal cross section with rounded corners.

4. A bin as defined in claim 1 wherein said top portion comprises a generally conically shaped wall that is connected with said main body portion.

5. A bin as defined in claim 1 wherein said bottom portion comprises a generally inverted conically shaped wall that is connected with said main body portion.

6. A bin as defined in claim 1 wherein said inlet is generally circular and said bin further comprises a removable cap for covering said inlet.

7. A bin as defined in claim 1 wherein said outlet is generally circular.

8. A bin as defined in claim 1 wherein said valve mechanism comprises a pair of slide valves configured to slide between open and closed positions.

9. A bin as defined in claim 1 further comprising a support frame structure for supporting said bin in an upright position.

10. A bin as defined in claim 1 wherein said indicator member comprises a directional arrow that is pivotable about its point end portion between said first and second positions, said arrow being pivotally mounted on a base connected to said valve mechanism between said two slide valves.

11. A method of storing and dispensing dry flowable material from a bin having a hopper with a wall dividing its lower portion into two sections, and at least one outlet at the bottom of the hopper that has a valve mechanism having first and second slide valves and that selectively controls dispensing from the two sections, said method comprising the steps of:

pivoting an indicator mechanism to a prevents opening of the first slide valve;

controlling the valve mechanism to open the second slide valve to dispense material from one of the sections;

dispensing the material from the one section until it is depleted;

determining that material is no longer flowing from the one section;

pivoting the indicator mechanism to a second position that prevents opening of the second slide valve;

controlling the valve mechanism to close the second slide valve for the one section and open the first slide valve to dispense material from the other section;

replenishing the material by filling the bin with additional material through the inlet; and repeating the foregoing steps including pivoting the indicator mechanism between the first and second positions as needed to continue said storing and dispensing.

* * * * *